US005851247A

United States Patent [19]

Stoetzel et al.

[11] Patent Number: 5,851,247

[45] Date of Patent: Dec. 22, 1998

[54] STRUCTURED ABRASIVE ARTICLE ADAPTED TO ABRADE A MILD STEEL WORKPIECE

[75] Inventors: William Lee Stoetzel, Lakeland; Eric George Larson, Lake Elmo; Jeff W. Nelson, Bayport, all of Minn.

[73] Assignee: Minnesota Mining & Manufacturing Company, St. Paul, Minn.

[21] Appl. No.: 936,441

[22] Filed: Sep. 24, 1997

Related U.S. Application Data

[63] Continuation-in-part of Ser. No. 803,791, Feb. 24, 1997, abandoned.

[51] Int. Cl.[6] ..... B24D 3/34

[52] U.S. Cl. ..... 51/295; 51/307; 51/308

[58] Field of Search ..... 51/295, 297, 307–309

[56] References Cited

U.S. PATENT DOCUMENTS

| | | | |
|---|---|---|---|
| 1,910,444 | 5/1933 | Nicholson . | |
| 2,001,911 | 5/1935 | Wooddell et al. | 51/190 |
| 3,048,482 | 8/1962 | Hurst | 51/298 |
| 3,549,341 | 12/1970 | Kittredge et al. | 51/293 |
| 3,859,407 | 1/1975 | Blanding et al. | 264/62 |
| 3,982,359 | 9/1976 | Elbel et al. | 51/295 |
| 4,311,489 | 1/1982 | Kressner | 51/298 |
| 4,364,746 | 12/1982 | Bitzer et al. | 51/298 |
| 4,393,021 | 7/1983 | Eisenberg et al. | 264/143 |
| 4,652,274 | 3/1987 | Boettcher et al. | 51/298 |
| 4,652,275 | 3/1987 | Bloecher et al. | 51/298 |
| 4,799,939 | 1/1989 | Bloecher et al. | 51/293 |
| 4,871,376 | 10/1989 | DeWald | 51/298 |
| 5,090,968 | 2/1992 | Pellow | 51/293 |
| 5,152,917 | 10/1992 | Pieper et al. | 51/295 |
| 5,201,916 | 4/1993 | Berg et al. | 51/293 |
| 5,256,703 | 10/1993 | Hermann et al. | 51/293 |
| 5,342,419 | 8/1994 | Hibbard | 51/308 |
| 5,344,472 | 10/1994 | Lynn et al. | 521/120 |
| 5,368,619 | 11/1994 | Culler | 51/308 |
| 5,378,251 | 1/1995 | Culler et al. | 51/295 |
| 5,435,816 | 7/1995 | Spurgeon et al. | 51/295 |
| 5,496,386 | 3/1996 | Broberg et al. | 51/295 |
| 5,500,273 | 3/1996 | Holmes et al. | 428/147 |
| 5,518,512 | 5/1996 | Hibbard | 51/308 |
| 5,549,962 | 8/1996 | Holmes et al. | 428/144 |
| 5,584,896 | 12/1996 | Broberg et al. | 51/295 |

FOREIGN PATENT DOCUMENTS

| | | |
|---|---|---|
| 0 615 816 A1 | 3/1994 | European Pat. Off. . |
| WO 92/07889 | 10/1991 | WIPO . |

OTHER PUBLICATIONS

"Trizact™ Abrasives A totally new abrasive construction"; 3M brochure; 1996.

"Relating Bearing Ratio to the Performance of Structured Coated Abrasives"; John J. Gagliardi; Society of Manufacturing Engineers; 1996.

*Primary Examiner*—Deborah Jones

*Attorney, Agent, or Firm*—Paul W. Busse

[57] ABSTRACT

The present invention is directed to a structured abrasive article that provides an enhanced cut rate and extended productive life when abrading mild steel workpieces. This abrasive article includes a backing having a surface that contains precisely shape abrasive composites. In this invention, the abrasive composites include a binder, abrasive particles, water-insoluble metal silicate particles and a coupling agent. The selection of the combination of these components or materials in an abrasive composite provides an abrasive article having an enhanced cut rate and extended productive life when used to abrade, finish or grind mild steel, particularly under wet conditions using water or water treated with rust inhibiting agents.

14 Claims, 3 Drawing Sheets

STRUCTURED ABRASIVE ARTICLE ADAPTED TO ABRADE A MILD STEEL WORKPIECE

This is a continuation-in-part of U.S. Ser. No. 08/803,791, filed on Feb. 24, 1997 now abandoned.

BACKGROUND

The present invention is directed to a structured abrasive article and to a method of using such an abrasive article. This structured abrasive article provides an enhanced cut rate and an extended or greater productive life when abrading, grinding, or finishing mild steel without the use of, or in the absence of, a grinding aid.

The uses of abrasive articles and products are nearly countless. Abrasive articles are used to finish a variety of materials ranging, for example, from exotic metal turbine blades used in jet engines to fiber optic cable connectors used in modern communication systems. The countless uses and materials that make use of abrasive articles in manufacturing or finishing processes require that the abrasive industry constantly improves these abrasive articles and products.

A traditional coated abrasive article is a layered material that basically includes a backing coated with a layer of a suitable adhesive or resin, or "make coat," that adheres randomly distributed abrasive particles to the backing. Known improvements to this basic construction may include one or more materials or layers that are applied over the adhered particles. These additional layers are generally added to increase the performance of the abrasive article, for example by reinforcing the abrasive particles to the backing, or to tailor the article to a particular application.

A notable improvement in coated abrasive articles over traditional coated abrasive articles is a recent coated abrasive construction that basically includes a backing coated with a layer of precisely shaped or structured abrasive composites. These abrasive composites contain abrasive particles dispersed throughout a three dimensional resin structure. The use of the precisely structured abrasive composites provides, in part, an even distribution of abrasive particles over the entire surface of the backing (as contrasted with the random distribution of abrasive particles in traditional coated abrasive articles) that provides consistent and reproducible product performance. A report of a coated abrasive construction having precisely shaped abrasive composites is found in U.S. Pat. No. 5,152,917 to Pieper et al. and commercial embodiments of these abrasive articles are sold under the trademark TRIZACT Abrasives by Minnesota Mining and Manufacturing Company, St. Paul, Minn. (3M).

Although the use of precisely shaped abrasive composites provides consistent and reproducible product performance, this construction further provides those skilled in the art with significant flexibility in developing new articles. For example, during use, the precisely shaped abrasive composites breakdown or erode to continually expose fresh abrasive particles or new abrading or cutting edges. In another example, the use of precisely shaped abrasive composites allows one skilled in the art to modify the chemical and/or physical properties of the abrasive composite in order to modify the performance characteristics of the abrasive article. In particular, U.S. Pat. Nos. 5,342,419 and 5,518,512 report using clay particles to modify the erosion rate of a precisely shaped abrasive composite. Further, U.S. Pat. No. 5,368,619 reports that selected silica particles can improve the manufacturing process of the precisely shaped abrasive composites. Still further, U.S. Pat. No. 5,378,251 reports that precisely shaped abrasive composites which include selected grinding aids have excellent abrading characteristics on metal workpieces.

In spite of the improvements already demonstrated by abrasive articles utilizing precisely shaped abrasive composites in their construction, there still is a need for abrasive articles which provide improved performance characteristics for the nearly unlimited types of abrading and grinding applications that may be accomplished with structured abrasive articles. The present invention is particularly suited to grind mild steel using moderate pressures under wet conditions without a need to use a grinding aid.

SUMMARY OF THE INVENTION

The present invention encompasses abrasive articles that provide an enhanced cut rate when abrading mild steel workpieces. This abrasive article includes a backing having a surface that contains precisely shaped abrasive composites. In this invention, the abrasive composites include a binder, abrasive particles, water-insoluble metal silicate particles and a coupling agent. The selection of the combination of these materials provides an abrasive composite that provides an enhanced cut rate and a longer productive life when used to abrade mild steel, even though no grinding aid is included, or is used, in the abrasive composite.

In a first aspect of the present invention an abrasive article is provided having precisely shaped abrasive composites which are formed "in-situ" during production of the abrasive article. Typically, and preferably the abrasive composites are adhered directly to the backing. Abrasive articles having abrasive composites adhered directly to the backing may be produced by the methods described in U.S. Pat. No. 5,152,917 (Pieper et al.), the disclosure of which is incorporated herein by reference.

In a second aspect of the present invention an abrasive article is provided having precisely shaped abrasive composite particles which are adhered to a backing by an adherent make coat. This embodiment is produced by first producing individual precisely shaped abrasive composite particles. Accordingly, a third aspect of the present invention provides precisely shaped abrasive composite particles. Precisely shaped abrasive particles include a binder having dispersed therein abrasive particles, water-insoluble metal silicate particles, and a coupling agent. The particles have a precise geometrical shape such as, for example, a cone, triangular prism, cylinder, pyramid, sphere, or cube. In the second aspect of the present invention the precisely shaped abrasive composite particles are adhered to the surface of a backing by an adherent coating, typically referred to as a "make coat." As used herein "make coat" refers to a coating which is applied to the backing for the purpose of adhering abrasive particles thereto. Optionally, additional coatings such as a size coat or supersize coat may be applied to further bond the abrasive composites to the backing or to provide other improved properties, such as antiloading. The precisely shaped abrasive composite particles may be oriented with respect to the backing in an non-random manner, or they may be randomly oriented with respect to the backing. Precisely shaped abrasive composite particles and abrasive articles made therefrom may be produced by the methods described in U.S. Pat. No. 5,500,273 (Holmes et al.), the disclosure of which is incorporated herein by reference.

In a fourth aspect of the present invention the abrasive composites and precisely shaped abrasive composite particles include about 20–40 parts by wt. binder, about 20–60 parts by wt. abrasive particles, about 10–40 parts by wt. water-insoluble metal silicate particles and about 0.01–2.5 parts by wt. coupling agent. In a preferred embodiment of this invention the abrasive composite includes about 30–35 parts by wt. binder, about 35–50 parts by wt. abrasive particles, about 15–30 parts by wt. water-insoluble metal silicate particles and about 1–2 parts by wt. coupling agent. The term, "water-insoluble metal silicate particles", means water-insoluble, inorganic filler particles of metal silicates, including orthosilicates and metasilicates, which may be used with the described binders, abrasive particles and coupling agents to provide the abrasive composition of this invention.

In a fifth aspect of the present invention a method of abrading a mild steel workpiece using the novel structured abrasive articles encompassed above is provided. The term "mild steel" means carbon steel with a maximum of about 0.25% carbon. This process provides an enhanced cut rate of a mild steel workpiece when a surface of the mild steel workpiece frictionally contacts or is abraded with the abrasive articles described above. The enhancement in cut rate and extended or prolonged productive life of the abrasive article when abrading, finishing or grinding mild steel workpieces is observed under wet conditions. Typical wet conditions include abrading, finishing or grinding mild steel workpieces in the presence of water or water which is treated with conventional rust inhibiting agents.

DETAILED DESCRIPTION

Figure 1:
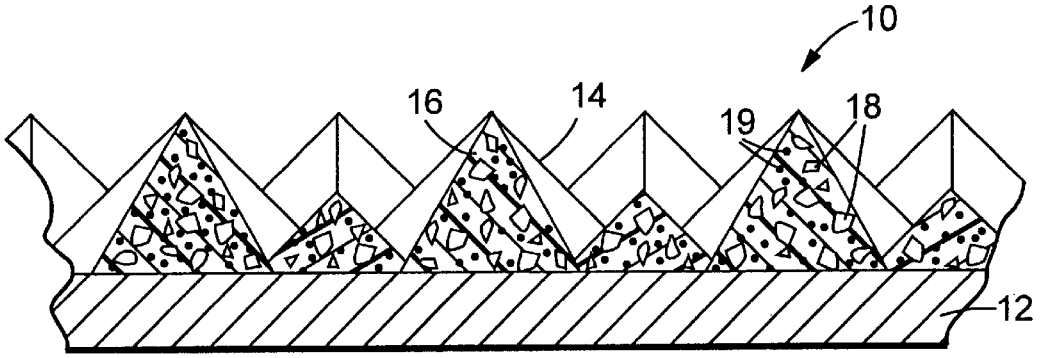
FIG. 1 is a section view of an embodiment of an abrasive article according to the present invention.

The present invention provides abrasive articles that are particularly adapted to abrade, finish or grind mild steel under medium pressures in processes using wet conditions. To date, grinding aids such as potassium tetrafluoroborate have been used in the abrasive composites of structured abrasive products to give higher cut rates. Although the abrasive articles of the present invention do not include a grinding aid, such as potassium tetrafluoroborate, the abrasive articles of this invention give enhanced cut rates for structured abrasive products.

The enhanced cut rate and greater productive life of the abrasive articles of the present invention are likely due, in part, to the incorporation of metal silicate particles in the abrasive composites. Different types of particles, other than abrasive particles, have been used in both conventional and structured abrasive articles. U.S. Pat. No. 4,871,376, for example reports that fillers or particles, other than abrasive particles, may be used in resin systems for making conventional coated abrasive articles. This patent also reports that a combination of fillers and coupling agents may improve the reported resin systems strength and improved resistance to deterioration when contacted with water. Further, this patent reports that calcium metasilicate particles may be used as a filler in order to provide such improved resin systems.

It should be noted, however, that conventional coated abrasive articles are very different from the abrasive article of the present invention. Specifically, conventional coated abrasive articles bind abrasive particles to a backing with a resin system and do not use a manufacturing technology based on the use of precisely shaped abrasive composites. For example, one of the advantages of an abrasive composite in an abrasive article is the ability to continuously provide new abrasive particles to the cutting interface as the abrasive composite wears during use. In order for such an abrasive composite to properly perform, the abrasive composite should be able to degrade or erode in use. If the binders in the abrasive composite are too strong or too tough, the composite will not erode and may actually result in a product that has decreased performance. In short, even though metal silicates have been used in abrasive articles, only the present invention provides for the use of metal silicates in an abrasive article that has precisely shaped abrasive composites.

Precisely shaped abrasive composites may be produced "in-situ" during the production of an abrasive article or, alternatively, precisely shaped abrasive composite particles may be produced in a first operation and adhered to a backing in a second operation. Abrasive composites typically consist essentially of about 20%–40% by weight binder, about 20%–60% by weight abrasive particles, about 10%–40% water-insoluble metal silicate particles, and about 0.01%–2.5% by weight coupling agent. More preferably, abrasive composites consists essentially of about 30%–35% by weight binder, about 35%–50% by weight abrasive particles, about 15%–30% by weight water-insoluble metal silicate particles, and about 1%–2% by weight coupling agent.

Figure 2:
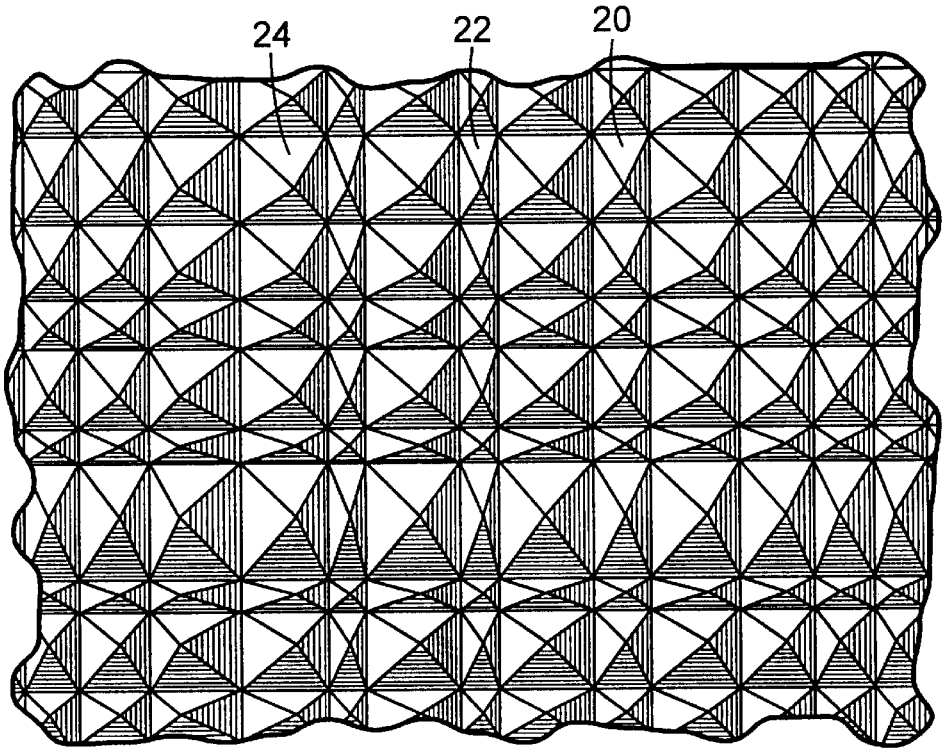
FIG. 2 is a preferred topography for abrasive composites of the abrasive article of FIG. 1.

Referring now to FIG. 1, a typical coated abrasive article having precisely shaped abrasive composites formed "in-situ" is shown. Coated abrasive article 10 comprises a backing 12 having on one major surface thereof abrasive composites 14. The abrasive composites consist essentially of binder 16, abrasive particles 18, water-insoluble metal silicate particles 19, and a coupling agent (not shown). Binder 16 bonds abrasive composite 14 to backing 12. FIG. 2 illustrates a top view of a preferred topography of precisely shaped abrasive composites of this invention. Inspection of this topography reveals that the abrasives composites are a plurality of differently dimensioned and shaped pyramids. That is, pyramid 20 in FIG. 2 is a differently dimensioned and shaped square pyramid as compared to pyramid 22, which in turn is a differently dimensioned and shaped square pyramid as compared to pyramid 24. This particular topography and methodologies for forming this topography are described in now allowed U.S. Ser. No. 08/678,366 filed on Jul. 17, 1996. This allowed application is incorporated by reference herein.

Figure 3:
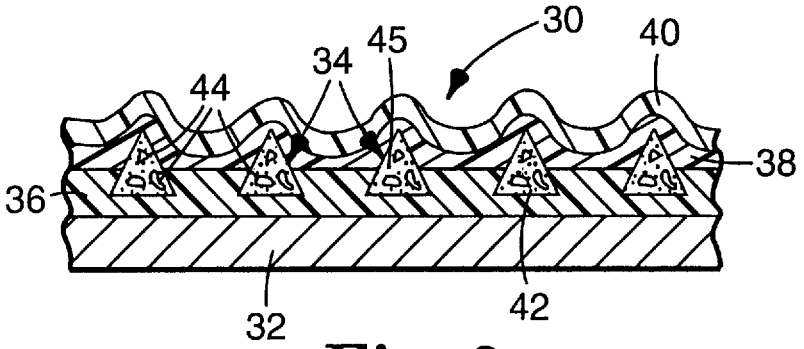
FIG. 3 is a section view of an embodiment of an abrasive article according to the present invention.
Figure 4:
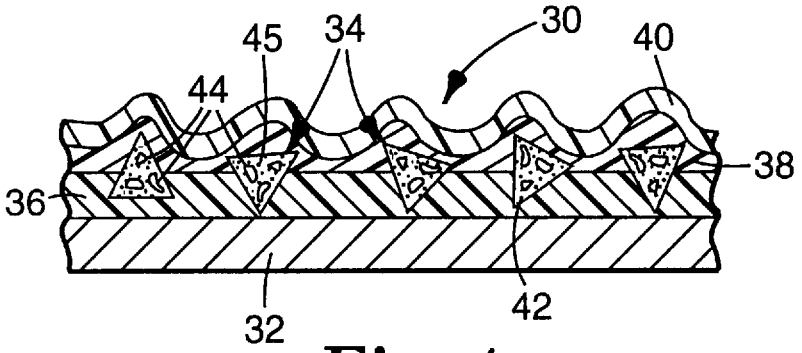
FIG. 4 is a section view of an embodiment of an abrasive article according to the present invention.

Abrasive articles having precisely shaped abrasive composites may also be prepared by producing precisely shaped abrasive composite particles in a first operation and adhering the precisely shaped abrasive composite particles to a backing in a second operation. Referring now to FIGS. 3 and 4 abrasive articles with precisely shaped abrasive composites produced by this method are shown. Abrasive article 30 comprises backing 32 having bonded on one surface precisely shaped abrasive composite particles 34. Abrasive particles 34 are bonded to backing 32 by two coatings.

Coating 36, commonly referred to as a make coat, is applied over backing 32 and bonds precisely shaped abrasive particles 34 to backing 32. Coating 38, commonly referred to as a size coat, is applied over abrasive particles 34 and reinforces abrasive particles 34. Optionally, a third coating 40, commonly referred to as a supersize coat, may be applied over the size coat 38. Precisely shaped abrasive composite particles 34 consist essentially of a binder 42, abrasive particles 44, water-insoluble metal silicate particles 45, and a coupling agent (not shown). The abrasive particles may be applied to the backing by conventional techniques, such as drop coating or electrostatic coating. Depending upon the coating method, the abrasive particles can be oriented with respect to the backing in a non-random manner, as in FIG. 3, or they may be oriented in a random manner with respect to the backing, as in FIG. 4.

Abrasive articles according to the present invention consist essentially of a backing, a binder, abrasive particles, water-insoluble metal silicate particles, and a coupling agent. Precisely shaped abrasive composite particles consist essentially of a binder, abrasive particles, water-insoluble metal silicate particles, and a coupling agent.

Backing

The backing of this invention has a front and a back surface and can be any conventional abrasive backing. Examples of useful backings include polymeric film, primed polymeric film, cloth, paper, vulcanized fiber, nonwovens, and combinations thereof. Other useful backings include a fibrous reinforced thermoplastic backing as disclosed in U.S. Pat. No. 5,316,812 and an endless seamless backing as disclosed in World Patent Application No. WO 93/12911. The backing may also contain a treatment or treatments to seal the backing and/or modify some physical properties of the backing. These treatments are well known in the art.

The backing may also have an attachment means on its back surface to enable securing the resulting coated abrasive to a support pad or back-up pad. The attachment means can be a pressure sensitive adhesive, one surface of a hook and loop attachment system, or threaded projections reported in U.S. Pat. No. 5,316,812. Alternatively, there may be an intermeshing attachment system and reported in U.S. Pat. No. 5,201,101.

The back side of the abrasive article may also contain a slip resistant or frictional coating. Examples of such coatings include an inorganic particulate (e.g., calcium carbonate or quartz) dispersed in an adhesive.

Binder

Binders are formed from flowable or liquid binder precursors which have been converted to a solid. During the production of an abrasive article, the binder precursor is exposed to the appropriate conditions (i.e., heat, ultraviolet radiation, visible radiation, or electron beam) to convert the binder precursor to a solid binder. Conversion of a flowable binder precursor to a solid binder is typically the result of a curing process, such as polymerization or crosslinking, although evaporation of a liquid from a binder dissolved or dispersed in a liquid (e.g., a thermoplastic polymer dissolved in a solvent) is also possible.

Binder precursors suitable for the present invention comprise a thermosetting resin that is capable of being cured by radiation energy or thermal energy. The binder precursor can polymerize via a condensation curing mechanism or an addition mechanism. Preferred binder precursors polymerize via an addition mechanism. Addition polymerization may proceed via a free radical mechanism or a cationic mechanism, or both mechanisms.

The binder precursor is preferably capable of being cured by radiation energy or thermal energy. Sources of radiation energy include electron beam energy, ultraviolet light, visible light, and laser light. If ultraviolet or visible light is utilized, a photoinitiator is preferably included in the mixture. Upon being exposed to ultraviolet or visible light, the photoinitiator generates a free radical source or a cationic source. This free radical source or cationic source initiates the polymerization of the binder precursor. A photoinitiator is optional when a source of electron beam energy is utilized.

Examples of binder precursors that are capable of being cured by radiation energy include acrylated urethanes, acrylated epoxies, ethylenically unsaturated compounds, aminoplast derivatives having pendant unsaturated carbonyl groups, isocyanurate derivatives having at least one pendant acrylate group, isocyanate derivatives having at least one pendant acrylate group, vinyl ethers, epoxy resins, and combinations thereof. The term acrylate includes both acrylates and methacrylates.

Acrylated urethanes are diacrylate esters of hydroxy terminated isocyanate extended polyesters or polyethers. Examples of commercially available acrylated urethanes include "UVITHANE 782", available from Morton Thiokol Chemical, and "EBECRYL 6600", "EBECRYL 8400", and "EBECRYL 8805", available from UCB Radcure Specialties.

Acrylated epoxies are diacrylate esters of epoxy resins, such as the diacrylate esters of bisphenol A epoxy resin. Examples of commercially available acrylated epoxies include "EBECRYL 3500", "EBECRYL 3600", and "EBECRYL 3700", available from UCB Radcure Specialties.

Ethylenically unsaturated compounds include both monomeric and polymeric compounds that contain atoms of carbon, hydrogen and oxygen, and optionally, nitrogen and the halogens. Oxygen or nitrogen atoms or both are generally present in ether, ester, urethane, amide, and urea groups. Ethylenically unsaturated compounds preferably have a molecular weight of less than about 4,000 grams/mole and are preferably esters resulting from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, maleic acid, and the like. Representative examples of acrylates include methyl methacrylate, ethyl methacrylate, ethylene glycol diacrylate, ethylene glycol methacrylate, hexanediol diacrylate, triethylene glycol diacrylate, trimethylolpropane triacrylate, glycerol triacrylate, pentaerthyitol triacrylate, pentaerythritol methacrylate, and pentaerythritol tetraacrylate. Other ethylenically unsaturated compounds include monoallyl, polyallyl, and polymethylallyl esters and amides of carboxylic acids, such as diallyl phthalate, diallyl adipate, and N,N-diallyladipamide. Still other ethylenically unsaturated compounds include styrene, divinyl benzene, and vinyl toluene. Other nitrogen-containing, ethylenically unsaturated compounds include tris(2-acryloyl-oxyethyl) isocyanurate, 1,3,5-tri(2-methyacryloxyethyl)-s-triazine, acrylamide, methylacrylamide, N-methylacrylamide, N,N-dimethylacrylamide, N-vinylpyrrolidone, and N-vinylpiperidone.

Aminoplast resins have at least one pendant $\alpha,\beta$-unsaturated carbonyl group per molecule and may be monomeric or oligomeric. These $\alpha,\beta$-unsaturated carbonyl groups can be acrylate, methacrylate, or acrylamide groups.

Examples of such resins include N-hydroxymethylacrylamide, N,N'-oxydimethylenebisacrylamide, ortho and para acrylamidomethylated phenol, acrylamidomethylated phenolic novolac, and combinations thereof. These materials are further reported in U.S. Pat. Nos. 4,903,440 and 5,236,472 both of which are incorporated herein by reference.

U.S. Pat. No. 4,652,274 reports a radiation curable binder which is a copolymer formed from (1) at least one monomer selected from the group consisting of isocyanurate derivatives having at least one terminal or pendant acrylate group and isocyanate derivatives having at least one terminal or pendant acrylate group, and (2) at least one aliphatic or cycloaliphatic monomer having at least one terminal or pendant acrylate group. The preferred monomer of the isocyanurate/isocyanate groups have a heterocyclic ring configuration, the preferred monomer being the reaction product of a mixture of acrylic acid and methacrylic acid with tris(hydroxyalkyl)isocyanurate. The preferred aliphatic or cycloaliphatic monomer of the group having at least one acrylate group is trimethylolpropanetriacrylate.

Examples of vinyl ethers suitable for this invention include vinyl ether functionalized urethane oligomers, commercially available from Allied Signal under the trade designations "VE 4010", "VE 4015", "VE 2010", "VE 2020", and "VE 4020".

Epoxies have an oxirane ring and are polymerized by the ring opening. Epoxy resins include monomeric epoxy resins and polymeric epoxy resins. These resins can vary greatly in the nature of their backbones and substituent groups. For example, the backbone may be of any type normally associated with epoxy resins and substituent groups thereon can be any group free of an active hydrogen atom that is reactive with an oxirane ring at room temperature. Representative examples of substituent groups for epoxy resins include halogens, ester groups, ether groups, sulfonate groups, siloxane groups, nitro groups, and phosphate groups. Examples of epoxy resins preferred for this invention include 2,2-bis [4-(2,3-epoxypropoxy)phenyl]propane (diglycidyl ether of bisphenol A) and materials under the trade designation "Epon 828", "Epon 1004" and "Epon 1001F", commercially available from Shell Chemical Co., "DER-331", "DER-332" and "DER-334", commercially available from Dow Chemical Co. Other suitable epoxy resins include glycidyl ethers of phenol formaldehyde novolac (e.g., "DEN-431" and "DEN-428", commercially available from Dow Chemical Co.). The epoxy resins of the invention can polymerize via a cationic mechanism with the addition of an appropriate photoinitiator(s). These resins are reported in U.S. Pat. No. 4,318,766 (Smith), and U.S. Pat. No. 4,751,138 (Tumey et al.).

Examples of photoinitiators that generate a free radical source when exposed to ultraviolet light include, but are not limited to, those selected from the group consisting of organic peroxides, azo compounds, quinones, benzophenones, nitroso compounds, acyl halides, hydrozones, mercapto compounds, pyrylium compounds, triacrylimidazoles, bisimidazoles, chloroalkytriazines, benzoin ethers, benzil ketals, thioxanthones, and acetophenone derivatives, and mixtures thereof. Examples of photoinitiators that generate a free radical source when exposed to visible radiation are reported in U.S. Pat. No. 4,735,632.

Cationic photoinitiators generate an acid source to initiate the polymerization of an epoxy resin or a urethane. Cationic photoinitiators can include a salt having an onium cation and a halogen-containing complex anion of a metal or metalloid. Other cationic photoinitiators include a salt having an organometallic complex cation and a halogen-containing complex anion of a metal or metalloid. These photoinitiators are further reported in U.S. Pat. No. 4,751,138, (col. 6, line 65 through col. 9, line 45). Another example is an organometallic salt and an onium salt reported in U.S. Pat. No. 4,985,340 (col. 4, line 65 through col. 14, line 50); European Patent Applications 306,161; 306,162. Still other cationic photoinitiators include an ionic salt of an organometallic complex in which the metal is selected from the elements of Periodic Groups IVB, VB, VIB, VIIB, and VIIIB. This photoinitiator is reported in European Patent Application 109,581.

Abrasive Particles

Abrasive particles suitable for the present invention typically have an average particle size ranging from about 0.1 to 1500 micrometers, preferably from about 1 to about 1300 micrometers, more preferably from about 1 to about 500 micrometers, and most preferably from about 1 to about 250 micrometers. It is preferred that the abrasive particles have a Mohs' hardness of at least about 8, more preferably above 9. Examples of materials of such abrasive particles include fused aluminum oxide, ceramic aluminum oxide, white fused aluminum oxide, heat treated aluminum oxide, silica, silicon carbide, green silicon carbide, alumina zirconia, diamond, ceria, cubic boron nitride, garnet, tripoli, and combinations thereof. The ceramic aluminum oxide is preferably made according to a sol-gel process, such as reported in U.S. Pat. Nos. 4,314,827; 4,744,802; 4,623,364; 4,770,671; 4,881,951; 5,011,508; and 5,213,591. The ceramic abrasive particles comprise alpha alumina and, optionally, a metal oxide modifier, such as magnesia, zirconia, zinc oxide, nickel oxide, hafnia, yttria, silica, iron oxide, titania, lanthanum oxide, ceria, neodynium oxide, and combinations thereof. The ceramic aluminum oxide may also optionally comprise a nucleating agent, such as alpha alumina, iron oxide, iron oxide precursor, titania, chromia, or combinations thereof. The ceramic aluminum oxide may also have a shape, such as that reported in U.S. Pat. Nos. 5,201,916 and 5,090,968. The ceramic abrasive particles may also contain a surface coating.

The abrasive particles may also have a surface coating. A surface coating can improve the adhesion between the abrasive particles and the binder and/or can alter the abrading characteristics of the abrasive particles. Such surface coatings are reported in U.S. Pat. Nos. 5,011,508; 1,910,444; 3,041,156; 5,009,675; 4,997,461; 5,213,591; and 5,042,991. Abrasive particles may also contain a coupling agent on their surface, such as a silane coupling agent.

The binder may contain a single type of abrasive particle, two or more types of different abrasive particles, or at least one type of abrasive particle with at least one type of diluent material. Examples of materials for diluents include calcium carbonate, glass bubbles, glass beads, greystone, marble, gypsum, clay, $SiO_2$, $KBF_4$, $Na_2SiF_6$, cryolite, organic bubbles, organic beads, and the like.

Water-Insoluble Metal Silicate Particles

Water-insoluble metal silicate particles suitable for the present invention include calcium silicate particles, zinc silicate particles, lead silicate particles, aluminum silicate particles, magnesium silicate particles, iron silicate particles, and cadmium silicate particles. Mixtures of these water-insoluble metal silicates may also be used in the present abrasive composition. A particularly preferred water-insoluble metal silicate is calcium metasilicate. Calcium metasilicate particles are commercially available and are sold under the trade designation "WOLLOSTONITE" by NYCO Company, Willsboro, N.Y. The NYCO Company also sells calcium metasilicate particles which have been treated with an amino silane coupling agent. These treated calcium metasilicate particles are commercially available under the trade designations "WOLLOSTAKUP" and "WOLLOSTACOAT" by NYCO Company.

Coupling Agents

Coupling agents suitable for the present invention provide an association bridge between the binder precursor and the water-insoluble metal silicate particles or abrasive particles. Examples of useful coupling agents include silanes, titanates, and zircoaluminates. An example of a coupling agent found suitable for this invention is the methacryloxypropyl silane known under the trade designation "A-174" from Union Carbide Corporation. Further examples which illustrate the use of silane, titanate, and zircoaluminate coupling agents are disclosed in U.S. Pat. Nos. 4,871,376 and 4,773,920. The term "coupling agent" may also include mixtures of coupling agents.

Abrasive composites according to the present invention may further include optional additives, such as, for example, fillers, fibers, lubricants, wetting agents, surfactants, pigments, dyes, plasticizers, antistatic agents, and suspending agents. Examples of fillers suitable for this invention include wood pulp, vermiculite, and combinations thereof, metal carbonates, such as calcium carbonate, e.g., chalk, calcite, marl, travertine, marble, and limestone, calcium magnesium carbonate, sodium carbonate, magnesium carbonate; silica, such as amorphous silica, quartz, glass beads, glass bubbles, and glass fibers; silicates, such as talc, clays (montmorillonite), feldspar, mica, calcium silicate, calcium metasilicate, sodium aluminosilicate, sodium silicate; metal sulfates, such as calcium sulfate, barium sulfate, sodium sulfate, aluminum sodium sulfate, aluminum sulfate; gypsum; vermiculite; wood flour; aluminum trihydrate; metal oxides, such as calcium oxide (lime), aluminum oxide, titanium dioxide, and metal sulfites, such as calcium sulfite.

Methods of Making an Abrasive Article

Abrasive Slurry

An essential step to make any of the inventive abrasive articles is to prepare an abrasive slurry. The slurry is made by combining together by any suitable mixing technique a binder precursor, abrasive particles, water-insoluble metal silicate particles, coupling agent, and optional additives. Examples of mixing techniques include low shear mixing and high shear mixing, with high shear mixing being preferred. Ultrasonic energy may also be utilized in combination with the mixing step to lower the viscosity of the abrasive slurry. Typically, the abrasive particles, water-insoluble metal silicate particles, and coupling agent are gradually added into the binder precursor. Alternatively, the water-insoluble metal silicate particles may be pre-treated with the coupling agent prior to addition to the binder precursor. The amount of air bubbles in the slurry can be minimized by pulling a vacuum during the mixing step. In some instances, it may be preferably to heat, generally in the range of 30° C. to 70° C., the slurry to lower the viscosity. It is important for the slurry to have rheological properties such that the slurry coats well and such that the abrasive particles, water-insoluble metal silicate particles, and fillers do not settle out of the slurry.

Energy Source

Once coated, the abrasive slurry is typically exposed to an energy source in order to convert the binder precursor to a solid binder. Conversion of the binder precursor to the binder is typically the result of a polymerization, crosslinking, or a drying process. The energy source may be a source of thermal energy, or radiation energy, such as, electron beam, ultraviolet light, or visible light. The total amount of energy required to convert the binder precursor into a binder is dependent upon the chemical structure of the of binder precursor, and the thickness and optical density of the abrasive slurry. When thermal energy is used, the oven temperature will typically range from about 50° C. to about 250° C., and the exposure time will typically range from about 15 minutes to about 16 hours.

For binder precursors solidified by free radical polymerization, suitable energy sources include electron beam, ultraviolet light, or visible light. Ultraviolet radiation refers to electromagnetic radiation having a wavelength in the range of about 200 to about 400 nanometers, preferably within the range of about 250 to 400 nanometers. Visible radiation refers to electromagnetic radiation having a wavelength in the range of about 400 to about 800 nanometers, and preferably in the range of about 400 to about 550 nanometers. Electron beam irradiation, a form of ionizing radiation, can be used at an energy level of about 0.1 to about 10 Mrad, preferably at an energy level of about 1 to about 10 Mrad, at accelerating potential ranging from about 150 to about 300 kiloelectron volts. The ultraviolet or visible radiation energy level (in the absence of heating) should be at least about 100 milliJoules/$cm^2$, more preferably from about 100 to about 700 milliJoules/$cm^2$, and particularly preferably from about 400 to about 600 milliJoules/$cm^2$. After the polymerization process is complete, the binder precursor is converted into a solid binder and the slurry is converted into an abrasive coating.

Production Tool

Production tools may be used to form abrasive articles having precisely shaped abrasive coatings or to produce precisely shaped abrasive composite particles. A production tool has a surface, defining a main plane, which contains a plurality of cavities distending as indentations from the main plane. These cavities define the inverse shape of the abrasive composite or abrasive composite particle and are responsible for generating the shape, size, and placement of the abrasive composites. The cavities can be provided in any geometric shape that is the inverse of a geometric shape which is suitable for an abrasive composite or abrasive composite particle, such as, cubic, cylindrical, prismatic, hemispheric, rectangular, pyramidal, truncated pyramidal, conical, truncated conical, and post-like with a flat top surface. The dimensions of the cavities are selected to achieve the desired areal density of abrasive composites. The cavities can be present in a dot like pattern where adjacent cavities butt up against one another. Preferably, the shape of the cavities is selected such that the surface area of the abrasive composite decreases away from the backing.

The production tool can take the form of a belt, sheet, continuous sheet or web, coating roll such as a rotogravure roll, sleeve mounted on a coating roll, or die. The production tool can be composed of metal (e.g., nickel), metal alloys, or plastic. The metal production tool can be fabricated by any conventional technique including but not limited to photolithography, knurling, engraving, hobbing, electroforming, and diamond turning.

A production tool made of thermoplastic material can be replicated from a master tool. When a production tool is replicated from a master tool, the master tool is provided with the inverse of the pattern which is desired for the production tool. The master tool is preferably made of a nickel-plated metal, such as nickel-plated aluminum, nickel-plated copper, or nickel-plated bronze. A production tool can be replicated from a master tool by pressing a sheet of thermoplastic material against the master tool while heating the master tool and/or the thermoplastic sheet such that the thermoplastic material is embossed with the master tool pattern. Alternatively, the thermoplastic material can be extruded or cast directly onto the master tool. The thermoplastic material is then cooled to a solid state and is separated from the master tool to produce a production tool. The production tool may optionally contain a release coating to permit easier release of the abrasive article. Examples of such release coatings include silicones and fluorochemicals. Preferred methods for the production of production tools are disclosed in U.S. Pat. Nos. 5,435,816 (Spurgeon et al.), 5,658,184 (Hoopman et al.), and in U.S. Ser. No. 08/923,862, "Method and Apparatus for Knurling a Workpiece, Method of Molding an Article with Such Workpiece, and Such Molded Article" (Hoopman), filed Sep. 3, 1997) the disclosures of which are incorporated herein by reference.

Abrasive Article Having Precisely Shaped Abrasive Composites

Figure 5:
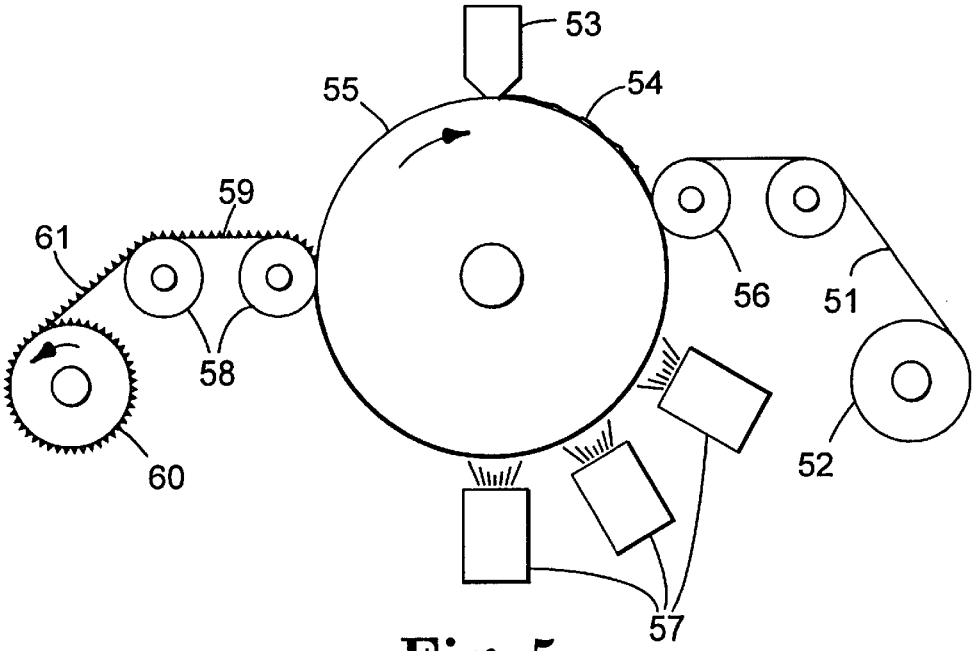
FIG. 5 is a schematic of a process for making the abrasive article of FIG. 1.

Abrasive articles having precisely shaped abrasive composites formed "in-situ" may be manufactured according to the method illustrate in FIG. 5. Backing 51 leaves an unwind station 52 and the slurry 54 is coated into the cavities of the production tool 55 by means of the coating station 53. The slurry can be coated onto the tool by any one of many techniques, such as drop die coating, roll coating, knife coating, curtain coating, vacuum die coating, or die coating. The slurry may be heated or subjected to ultrasonic energy to lower the viscosity. During coating the formation of air bubbles should be minimized. The backing and the production tool containing the abrasive slurry are brought into contact by a nip roll 56 such that the slurry wets the front surface of the backing. Next, the binder precursor in the slurry is at least partially cured by exposure to an energy source 57. After this at least particle cure, the slurry is converted to an abrasive composite 59 that is bonded or adhered to the backing. The resulting abrasive article is removed from the production tool by means of nip rolls 58 and wound onto a rewind station 60. In this method, the energy source can be thermal energy or radiation energy. If the energy source is either ultraviolet light or visible light, it is preferred that the backing be transparent to ultraviolet or visible light.

Alternatively, the slurry can be coated directly onto the front surface of the backing. The slurry coated backing is then brought into contact with the production tool such that the slurry wets into the cavities of the production tool. The remaining steps are as detailed above.

Abrasive Articles Made From Precisely Shaped Abrasive Composite Particles

According to the present invention, coated abrasive articles having precisely shaped abrasive composites may be produced by first producing precisely shaped abrasive composite particles which are then bonded to a backing by an adherent coating or series of coatings.

Figure 6:
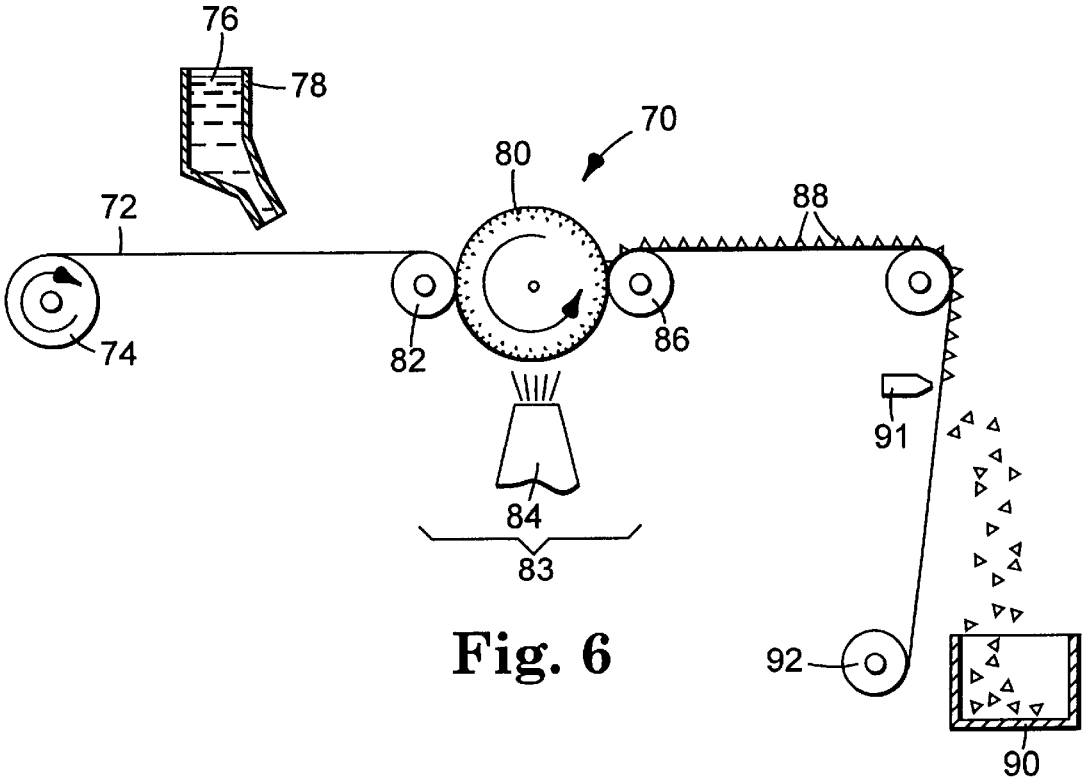
FIG. 6 is a schematic of a process for making precisely shaped abrasive composite particles.

A typical manufacturing process for producing precisely shaped abrasive composite particles is illustrated in FIG. 6. Apparatus 70 comprises a carrier web 72 which is fed from an unwind station 74. Unwind station 74 is in the form of a roll. The carrier web 72 can be made of a material such as paper, cloth, polymeric film, nonwoven web, vulcanized fiber, combinations thereof and treated versions thereof. The preferred material for the carrier web 72 is a polymeric film, such as, for example, a polyester film. In FIG. 6, the carrier web 72 is transparent to radiation. A binder precursor 76 is fed by gravity from a hopper 78 onto a major surface of the carrier web 72. The major surface of the carrier web 72 containing the binder precursor 76 is forced against the surface of a production tool 80 by means of a nip roll 82. The surface of the production tool 80 that contacts the carrier web contains openings leading to precisely shaped cavities. The cavities shape the precisely shaped abrasive composite particles. The nip roll 82 also aids in forcing the binder precursor 76 into the cavities of the production tool 80. The binder precursor 76 then travels through a curing zone 83 where it is exposed to an energy source 84 to at least partially cure the binder precursor 76 to form a solidified, handleable binder. Next, the carrier web 72 containing the solidified, handleable binder is passed over a nip roll 86. There must be sufficient adhesion between the carrier web 72 and the solidified, handleable binder in order to allow for subsequent removal of the binder from the cavities of the production tool 80. The particles of binder material 88 are removed from the carrier web 72 and collected in a container 90. External means 91 (e.g., ultrasonic energy) can be used to help release the particles 88 from the carrier web 72. The carrier web 72 is then recovered at rewind station 92 so that it can be reused. Rewind station 92 is in the form of a roll. Other methods for the production of precisely shaped abrasive particles are reported in U.S. Pat. No. 5,500,273 (Holmes et al.).

Typically, the precisely shaped abrasive composite particles have no dimension greater than 2500 micrometers. It is preferred that the size of the precisely shaped abrasive composite particles range from about 0.1 to about 1500 micrometers, more preferably from about 0.1 to about 500 micrometers. As indicated previously, the precise shape corresponds to portions of the surface of the production tool, e.g., cavities formed in the surface of the production tool. The particles of this invention have a precise shape. This precise shape is attributable to the binder precursor's being at least partially cured in the cavities of the production tool. There may, however, be minor imperfections in the particles that are introduced when the particles are removed from the cavities. If the binder precursor is not sufficiently cured in the cavities, the binder precursor will flow, and the resulting shape will not correspond to the shape of the cavities. This lack of correspondence gives an imprecise and irregular shape to the particle. The precise shape can be any geometrical shape, such as a cone, triangular prism, cylinder, pyramid, sphere, and a body having two opposed polygonal faces separated by a constant or varying distance, i.e., a polygonal platelet. Pyramids preferably have bases having three or four sides. The abrasive article may contain a variety of abrasive particles having different shapes.

A coated abrasive article utilizing the precisely shaped abrasive composite particles can be made according to the following procedure. A backing having a front surface and a back surface is provided. The front surface of the backing is coated with a first curable coating, typically referred to as a make coat. The precisely shaped abrasive composite particles are then coated or applied to the first curable coating. The precisely shaped abrasive composite particles can be drop coated or electrostatic coated. The abrasive particles can be coated or placed randomly onto the backing. Alternatively, the abrasive particles can be oriented on the backing in a specified direction. In the case of precisely shaped abrasive composite particles having the shapes of pyramids, cones, and prisms (e.g., triangular-shaped prisms), the particles can be oriented so that their bases point toward the backing and their vertexes point away from the backing, as in FIG. 3, or they can be oriented so that their vertexes point toward the backing and their bases point away from the backing, as do four of the particles in FIG. 4. With respect to pyramids and cones, the vertex referred to is the common vertex. The first curable coating is then solidified or cured to adhere the particles to the backing. Optionally, a second curable coating can be applied over the precisely shaped abrasive composite particles and then solidified or cured to form a size coat. The second curable coating can be applied prior to or subsequent to solidification or curing of the first curable coating. The size coat further bonds the abrasive particles to the backing. Optionally, additional coatings, such as a supersize coat can be applied over the abrasive particles and size coat.

The first and second curable coatings comprise a curable resin and optional additives. Examples of resins suitable for this invention include phenolic resins, aminoplast resins, urethane resins, epoxy resins, acrylate resins, acrylated isocyanurate resins, urea-formaldehyde resins, isocyanurate resins, acrylated urethane resins, vinyl ethers, acrylated epoxy resins, and combinations thereof. Optional additives include fillers, fibers, lubricants, wetting agents, surfactants, pigments, dyes, coupling agents, plasticizers, and suspending agents. Examples of fillers include talc, calcium carbonate, calcium metasilicate, silica and combinations thereof. The amounts of these materials are selected to provide the properties desired. The make coat and size coat may be the same formulation or a different formulation.

Method of Abrading a Workpiece

One aspect of this invention pertains to a method of abrading a mild steel workpiece. This method involves bringing into frictional contact the abrasive article of this invention with a workpiece having a mild steel surface. The term "abrading" means that a portion of the metal workpiece is cut or removed by the abrasive article. Abrasive articles according to the present invention provide an enhanced cut when abrading mild steel workpieces under medium pressure in processes in wet conditions.

Depending upon the application, there may be a liquid present during abrading. The liquid can be water, water containing conventional rust inhibiting compounds, or an organic compound, such as a lubricant, oil, or cutting fluid.

Depending upon the application, the force at the abrading interface can range from about 0.1 kg to 1000 kg. Generally, this range is from about 1 kg to 500 kg of force at the abrading interface.

The abrasive articles of the present invention can be used by hand or used in combination with a machine. At least one or both of the abrasive article and the workpiece is moved relative to the other during grinding. The abrasive article can be converted into a belt, tape roll, disc, or sheet. For belt applications, the two free ends of the abrasive sheet are joined together and a splice is formed.

EXAMPLES

The following examples will further illustrate specific embodiments of the present invention. Those of ordinary skill in the art will recognize that the present invention also includes modifications and alterations of the embodiments set out in the examples and that the illustrative examples do not limit the scope of the claimed invention.

The following abbreviations are used in the Examples. All parts, percentages, ratios, etc., in the examples are by weight unless otherwise indicated.

| | |
|---|---|
| AO | fused aluminum oxide abrasive particles; |
| ASF | amorphous silica filler, commercially available from DeGussa Corp. under the trade designation "OX-50"; |
| CaCO3 | calcium carbonate filler; |
| CMSK | treated calcium metasilicate filler, commercially available from NYCO, Willsboro, NY under the trade designation "WOLLOSTOKUP"; |
| CRY | potassium cryolite grinding aid particles; |
| D111 | dispersing agent, commercially available from Byk Chemie, Wallingford, CT under the trade designation "Disperbyk 111"; |
| DIW | deionized water; |
| KB1 | 2,2-dimethoxy-1,2-diphenylethanone, commercially available from Lamberti S.P.A. (through Sartomer) under the trade designation "ESACURE KB 1"; |
| KBF4 | potassium tetrafluoroborate; |
| PETA | pentaerythritol triacrylate, commercially available from Sartomer Co., under the trade designation "SR444"; |
| PH2 | 2-benzyl-2-N,N-dimethylamino-1-(4-morpholinophenyl)-1-butanone, commercially available from Ciba Geigy Corp. under the trade designation "Irgacure 369"; |
| PH3 | 2-phenyl-2,2-dimethoxyacetophenon, commercially available from Ciba Geigy under the trade designation "Irgacure 651"; |
| PRO | a mixture of 60/40/1 TMPTA/TATHEIC/KB1; |
| Q2 | silicone antifoam, commercially available from Dow Corning Co., Midland, MI under the trade designation "1520"; |
| R23155 | metal hydroxide catalyzed phenolic resole resin approximately 75% solids in water. |
| SCA | silane coupling agent, 3-methacryloxypropyl-trimethoxysilane, commercially available from Union Carbide under the trade designation "A-174"; |
| TATHEIC | triacrylate of tris(hydroxy ethyl)isocyanurate, commercially available from Sartomer Co., under the trade designation "SR368"; |
| TMPTA | trimethylol propane triacrylate, commercially available from Sartomer under the trade designation "SR351". |

Procedure For Making Abrasive Article Having Precisely Shaped Abrasive Composites

Production Procedure 1

The following general procedure, reported in U.S. Pat. Nos. 5,152,917 and 5,435,816, both incorporated herein by reference, was used to make the structured abrasive articles reported in Examples 1–6.

First, an abrasive slurry, comprising a binder precursor, was prepared by thoroughly mixing the raw materials as listed in a high shear mixer. The abrasive slurry was coated onto the cavities of a production tool at a speed of about 15.24 meters/minute with a knife coater using a 76 micrometer gap, so that the abrasive slurry filled the cavities.

The production tool and the process to make the tool are described in allowed U.S. Ser. No. 08/678,366, incorporated herein by reference. The specific abrasive composites formed by the production tool used in Examples 1–6 were 355 micrometer (14 mil) high, four sided pyramids. The pattern of pyramids formed by the production tool was such that no two adjacent pyramids had the same shape, i.e., the angles between adjacent pyramids were random as were the lengths of the sides of the pyramids. The minimum and maximum angles between two adjacent pyramids were 30 and 90 degrees, respectively. The minimum and maximum pyramid side lengths were 412 and 711 micrometers (16.2 and 28 mils), respectively.

Next a phenolic/latex treated polyester/cotton cloth backing, approximate weight 350 g/m$^2$, was pressed against the slurry filled cavities of the production tool by means of a roller so that the abrasive slurry wetted the front surface of the cloth. UV/visible radiation, at a dosage of about 236 Watts/cm (600 Watts/inch) produced by 2 "D" bulbs, available from Fusion Systems, was transmitted through the tooling and into the abrasive slurry. The UV/visible radiation initiated the polymerization of the binder precursor and resulted in the abrasive slurry forming abrasive composites which were adhered or fixed to the cloth substrate.

Finally, the abrasive composite construction was separated from the production tool to form an abrasive article.

Test Procedure 1

Abrasive articles prepared by the above method were converted to a 7.62 cm by 203 cm (3×80 inch) endless belt according to conventional process and tested on a constant infeed surface grinder. The belt was mounted on the surface grinder which had a 45.72 cm (18 inch) smooth rubber 90 Shore D durometer driven contact wheel. The belt was driven at 1706 meters/minute (5600 ft/min). A 1018 mild steel workpiece was positioned horizontally and reciprocated parallel to the belt at 6.09 meters/minute (20 ft/min). The workpiece was incrementally pressed against the belt at 6.35 micrometers/pass (0.25 mil/pass) (i.e., downfeed). The test was run under a water flood, and testing was ended when the abrasive coating was essentially entirely eroded from the backing.

Example 1

The abrasive article of Example 1 was prepared by mixing 1595 parts PRO, 8 parts KB1, 80 parts SCA and 955 parts CMSK, and then adding 45 parts AO (having an average particle size of about 45 micrometers) to 55 parts of the mixture. This abrasive slurry was then further processed as outlined in Production Procedure 1. Comparative Example A was a structured abrasive belt having KBF4 grinding aid and ASF filler present in the abrasive composites and having the same abrasive composites formulation as an abrasive belt that is commercially available from 3M, St. Paul, Minn. under the trade designation "TRIZACT 237AA."

The abrasive articles of Example 1 and Comparative Example A were tested according to the Test Procedure 1. The test was run under a water flood. The test was ended when the abrasive coating essentially entirely eroded from the backing. The abrasive article of Example 1 achieved 178 passes and the abrasive article of Comparative Example A achieved 97 passes.

Example 2

The abrasive article of Example 2 was prepared by mixing 8820 parts PRO, 44 parts KB1, 441 parts SCA and 6615 parts CMSK, and then adding 39 parts AO (having an average particle size of about 45 micrometers) to 61 parts of the mixture. This abrasive slurry was then further processed as described in Production Procedure 1.

The abrasive articles of Example 2 and Comparative Example A were tested according to Test Procedure 1. The abrasive article of Example 2 achieved 166 passes and the abrasive article of Comparative Example A achieved 145 passes.

Examples 3 and 4

The abrasive article of Example 3 was prepared as described in Example 2, except 42 parts AO to 58 parts of the mixture. The abrasive article of Example 4 was prepared as described in Example 3, except 2205 parts KBF4 and only 4410 parts CMSK were used.

The abrasive articles of Examples 3 and 4 were tested according to Test Procedure 1. The abrasive article of Example 3 achieved 172 passes and the abrasive article of Example 4 achieved 138 passes.

Examples 5 and 6

The abrasive articles of Example 5 and Example 6 were prepared as described in Examples 3 and 4, respectively, except that the abrasive particles had an average particle size of about 100 micrometers and the topography had 455 micrometer (18 mil) high pyramids rather than 355 micrometers (14 mil). These pyramids had minimum and maximum side lengths of 528 and 914 micrometers (20.8 and 36 mils).

The abrasive articles of Examples 5 and 6 were tested according to Test Procedure 1, except that the downfeed was increased to 12.7 micrometers/pass (0.5 mil/pass). Example 5 achieved 256 passes and Example 6 achieved 140 passes.

Procedure For Making Abrasive Articles Made From Precisely Shaped Abrasive Composite Particles Production Procedure 2

The following general procedure, particularly described in U.S. Pat. No. 5,500,273, (Holmes et al.), was used to make the structured abrasive particles reported in Example 7 and Comparative Examples B.

The production tool and the process to make the tool are described in U.S. Pat. No. 5,435,816 (Spurgeon et al.) and PCT publication WO97/12727 (Hoopman et al.), both incorporated herein by reference. The precisely shaped abrasive particles of Example 7 and Comparative Example B were 533 micrometer (21 mil) high, four sided pyramids with 1371 micrometer (54 mil) bases made in a production tool which was formed using the knurling teachings of WO97/12727.

First, an abrasive slurry, comprising a binder precursor, was prepared by thoroughly mixing the raw materials listed in Table 1 in a high shear mixer. The abrasive slurry was coated onto the cavities of a production tool using a knife coater with a 76 micrometer gap operating at a speed of about 15.24 meters/minute (50 ft/min). The abrasive slurry filled the cavities of the production tool.

Next, a 75 micrometer (3 mil) thick polyester film primed with an ethylene acrylic acid copolymer, was pressed against the slurry filled cavities of the production tool by means of a roller so that the abrasive slurry wetted the front surface of the film. UV/visible radiation, at a dosage of about 236 Watts/cm (600 Watts/inch) produced by 2 "D" bulbs, available from Fusion Systems, was transmitted through the tooling and into the abrasive slurry. The UV/visible radiation initiated the polymerization of the binder precursor and resulted in the abrasive slurry forming precisely shaped abrasive composite particles which were adhered to the film substrate.

Finally, the abrasive particle construction was separated from the production tool, and the precisely shaped abrasive composite particles were removed from the backing by an ultrasonic horn oscillated at a frequency of 19,100 Hz, at an amplitude of about 130 micrometers so that individual free flowing particles were obtained. Any particles which were not individual were passed through a rubber roller to break up any agglomerated particles.

Strips of coated abrasive measuring 10 cm (4 inches) wide by 111.76 cm (44 inches) long were prepared using the following general procedure. A conventional calcium carbonate filled phenolic resin make coat was applied with a die coater at a weight of approximately 0.0266 g/cm$^2$ (2.75 g/16 in$^2$) onto a 350 g/m$^2$ phenolic/latex treated polyester/cotton cloth backing. Next, the precisely shaped abrasive composite particles were drop coated onto the make coat at a weight of approximately 0.0774 g/cm$^2$ (8 g/16 in$^2$) to produce a closed coat. Phenolic resin was applied over the particles with a paint brush to provide a size coat. The approximate weight of the size coat is reported in each example. The coated abrasive belts were heated in a convection oven at 93° C. (200° F.) for 90 minutes, and then at 110° C. (230° F.) for 10 hours. After curing, the belts were cut to 168 cm by 7.6 cm and were spliced with a conventional butt splice.

Test Procedure 2

The coated abrasive belts were tested on an ELB reciprocating bed grinding machine available from ELB Grinders Corp., Mountainside, N.J., under the trade designation "ELB Type SPA 2030ND". The effective cutting area of the abrasive belt was 7.6 cm by 168 cm. The workpiece abraded by the belts was a 1018 mild steel workpiece having the dimensions 1.3 cm (width) by 35 cm (length) by 10 cm (height). Abrading was conducted along the 1.3 cm by 35 cm edge. The workpiece was mounted on a reciprocating table. The speed of the abrasive belt was 1676 meters/minute (5500 surface feet per minute). The table speed, at which the workpiece traversed, was 6.1 meters/minute (20 ft/min). The process used was conventional surface grinding wherein the workpiece was reciprocated beneath the rotating abrasive belt with incremental downfeeding of 12.7 micrometers (0.5 mil) per pass of the workpiece and 1.14 cm (0.45 inch) crossfeed. This grinding was carried out under a water feed of 22.8 liters/minute (6 gpm). The endpoint of the test was the point at which substantially all of the abrasive coating was worn off of the backing. The workpiece was weighed both at the beginning and at the end of the test. The difference in the weight of the workpiece was reported as cut.

Example 7 and Comparative Example B

The precisely shaped abrasive particles of Example 7 and Comparative Example B were prepared by mixing the ingredients listed in Table 1 and following the Production Procedure 2. The AO used was a grade P180 (average particle size about 45 micrometers).

TABLE 1

| | Comp B | Example 7 |
|---|---|---|
| PETA | 850 | 850 |
| R23155 | 1150 | 1150 |
| CaCO3 | 1200 | 0 |
| CMSK | 0 | 1200 |
| AO | 3800 | 3800 |
| SCA | 60 | 60 |
| Q2 | 1.5 | 1.5 |
| PH3 | 26 | 26 |

Two lots of coated abrasive belts, "A" and "B" were made with each example. Lot B utilized a size resin weight of about 0.0543 g/cm$^2$ (0.35 g/in$^2$), and lot B utilized a size resin weight of about 0.0636 g/cm$^2$ (0.41 g/in$^2$). At least two belts of each lot were tested using Test Procedure 2, and the averaged total cut of the belts is reported in Table 2.

TABLE 2

| Example | Avg. Cut (g) |
|---|---|
| Comp. B (lot A) | 185 |
| Comp. B (lot B) | 185 |
| 7 (lot A) | 310 |
| 7 (lot B) | 309 |

Examples 8–10

The precisely shaped abrasive particles of Examples 8–10 were prepared by mixing the ingredients listed in Table 3 to create a pre-mix. Abrasive grains were then added to this pre-mix at the ratio listed in Table 4. The AO had an average particles size of about 45 micrometers.

TABLE 3

| | Example 8 | Example 9 | Example 10 |
|---|---|---|---|
| PETA | 8600 | 7740 | 0 |
| R23155 | 0 | 1145 | 0 |
| TMPTA | 0 | 0 | 8600 |
| PH3 | 100 | 100 | 100 |
| ASF | 300 | 0 | 300 |
| SCA | 300 | 300 | 300 |
| CMSK | 6000 | 6000 | 6000 |
| Q2 | 7.5 | 7.5 | 7.5 |
| D111 | 5 | 7 | 7 |
| DIW | 0 | 340 | 0 |

TABLE 4

| | Example 8 | Example 9 | Example 10 |
|---|---|---|---|
| pre-mix | 15.3 | 15.2 | 15.3 |
| AO | 18 | 17.7 | 18 |

The particle preparation differed from the general procedure in that the backing used was a corona-treated 75 micrometer thick polyester film, the speed was approximately 45.72 meters/minute (150 ft/min), and the slurry was heated to 33° C. (92° F.) for Examples 8 and 10 and to 43° C. (110° F.) for Example 9.

Four coated abrasive belts were made with the particles of each Example; a pair at a low size level ("A") and a pair at a high size level ("B"). Table 5 shows the size resin weight for each belt, and the average cut. The belts were tested as described in Test Procedure 2.

TABLE 5

| Example | Size wt. (grams/in$^2$) | Ave. Cut (grams) |
|---|---|---|
| 8 (lot A) | 0.265 | 328 |
| 8 (lot B) | 0.303 | 366 |
| 9 (lot A) | 0.279 | 422 |
| 9 (lot B) | 0.309 | 415 |
| 10 (lot A) | 0.264 | 288 |
| 10 (lot B) | 0.299 | 303 |
| Comp. B (lot A) | 0.41 | 185 |
| Comp. B (lot B) | 0.41 | 185 |

Although the selected test procedures are subject to variability related, in part, to different individual workpieces and to differences in lots of abrasive articles, the testing data indicates that the abrasive composites of the present invention provide abrasive articles that have an enhanced cut rate and a longer productive life when mild steel workpieces are abraded under wet conditions.

We claim:

1. An abrasive article comprising precisely shaped abrasive composites adhered to a major surface of a backing, wherein the precisely shaped abrasive composites consist essentially of:

a binder;

abrasive particles;

water-insoluble metal silicate particles; and a coupling agent;

wherein the abrasive composites provide an enhanced cut rate for a mild steel workpiece in the absence of a grinding aid.

2. An abrasive article according to claim 1 wherein the precisely shaped abrasive composites are adhered directly to the backing.

3. An abrasive article according to claim 1 wherein the precisely shaped abrasive composites comprise precisely shaped abrasive composite particles which are adhered to the backing by a make coat.

4. An abrasive article according to claim 3 wherein the precisely shaped abrasive composite particles are adhered to the backing by a make coat and a size coat.

5. The abrasive composite of claim 1 consisting essentially of about 20–40 parts by wt. binder, about 20–60 parts by wt. abrasive particles, about 10–40 parts by wt. water-insoluble metal silicate particles and about 0.01–2.5 parts by wt. coupling agent.

6. The abrasive composite of claim 1 consisting essentially of about 30–35 parts by wt. binder, about 35–50 parts by wt. abrasive particles, about 15–30 parts by wt. water-insoluble metal silicate particles and about 1–2 parts by wt. coupling agent.

7. The abrasive composite of claim 1 wherein the water-insoluble metal silicate particles are selected from the group consisting of calcium silicate particles, zinc silicate particles, lead silicate particles, aluminum silicate particles, magnesium silicate particles, iron silicate particles, cadmium silicate particles and mixtures thereof.

8. The abrasive composite of claim 1 wherein the water-insoluble metal silicate particles are calcium metasilicate particles.

9. The abrasive composite of claim 1 wherein the water-insoluble metal silicate particles are coated with the coupling agent.

10. A method of abrading a mild steel workpiece comprising the step of frictionally contacting a surface of the mild steel workpiece with an abrasive article of claim 1.

11. The method of claim 10 wherein the contact occurs in the presence of a liquid.

12. The method of claim 10 wherein the contact occurs in water or in water treated with rust inhibiting agents.

13. A precisely shaped abrasive composite particle comprising:

a binder;

abrasive particles;

water-insoluble metal silicate particles; and a coupling agent;

wherein the abrasive particles provide an enhanced cut rate for a mild steel workpiece in the absence of a grinding aid.

14. A coated abrasive article made with the precisely shaped abrasive composite particles of claim 13.

* * * * *